US005992022A

United States Patent [19]

Carrera Moya

[11] Patent Number: 5,992,022

[45] Date of Patent: Nov. 30, 1999

[54] CIGAR CUTTER

[75] Inventor: Juan José Carrera Moya, San Agustin de Guadalix, Spain

[73] Assignee: Carrera y Carrera, S.A., Madrid, Spain

[21] Appl. No.: 09/154,976

[22] Filed: Sep. 17, 1998

[30] Foreign Application Priority Data

Oct. 31, 1997 [ES] Spain ..... 9702817 U

[51] Int. Cl.[6] ..... A24F 13/24

[52] U.S. Cl. ..... 30/113; 30/278; 131/248

[58] Field of Search ..... 30/109, 111, 113, 30/278; 131/248, 250, 252, 253

[56] References Cited

U.S. PATENT DOCUMENTS

| | | | |
|---|---|---|---|
| 256,093 | 4/1882 | Yates | 30/113 |
| 257,925 | 5/1882 | Faas | 30/113 |
| 1,058,999 | 4/1913 | Patten | 30/113 |
| 1,061,236 | 5/1913 | Fuller | 30/113 |
| 1,086,463 | 2/1914 | Robbins | 30/113 |
| 1,119,220 | 12/1914 | Bates | 30/113 |
| 1,166,881 | 1/1916 | Anderson | 30/113 |
| 5,791,051 | 8/1998 | Schmidt | 30/113 |

OTHER PUBLICATIONS

Spanish Utility Model No.: 231.715, Oct. 1977.
Spanish Utility Model No.: 260,436, Sep. 1981.
Spanish Utility Model No.: 287.023, May 1985.
Spanish Utility Model No.: U–9101517, May 1991.
Spanish Utility Model No.: U–9200936, Apr. 1992.

*Primary Examiner*—Hwei-Siu Payer
*Attorney, Agent, or Firm*—Klauber & Jackson

[57] ABSTRACT

The cigar cutter object of the invention consists of a cutting blade (1) with an oblique cutting edge (2), this blade being able to move in an axial direction and in a guided form between two plates (3) and (3') which are duly fixed one to the other. The cutting blade (1) is fixed to a bridging piece (7) with a pair of pins equipped with springs (10) which push the piece (7), and consequently the cutting blade (1), into the non-operational position, that is, with the cutting edge (2) of the latter above the opposing orifices (4) of the plates (3) and (3'), through which is inserted the extremity of the cigar to be cut. The device is operated by manually depressing the piece (7) via an external push button (30) attached to the piece (7), resulting in the displacement of the latter and of the cutting blade (1) that will slice through the extremity of the cigar inserted into the space determined by the aligned orifices (4). The cigar cutter is completed with a noble metal cover or casing (21), in which are made the orifices (23) that line up with the orifices (4) in which the cigar is positioned, and also includes a locking mechanism (15-16-17) to retain the cutting blade (1) in the non-operational position, the mechanism being released by means of a push button (18).

6 Claims, 3 Drawing Sheets

CIGAR CUTTER

OBJECT OF THE INVENTION

This invention, as stated in the title of this technical description, concerns an improved cigar cutter, which incorporates a series of innovations and improvements with respect to the conventional types and result in a more effective operation, a more rational construction and a better finish.

The object of the invention is to provide a cigar cutter, with features and characteristics such that, in addition to performing its function effectively, it is encased in an external cover with a high quality, aesthetic finish, whereby it also proves to be attractive.

BACKGROUND TO THE INVENTION

Presently known, among others, is a type of cigar cutter based on a cutting blade that works like a guillotine, the said blade having an oblique cutting edge; the former slides in a guided manner inside a flat frame generally formed by two parallel-mounted, facing plates each of which has an orifice, the orifices being opposite each other and forming the space into which is inserted the extremity of the cigar to be cut, this extremity being that which is sliced by the guillotine blade which slides between the two plates, the movement being achieved by pushing manually from the exterior.

In this respect, and in relation with this type of cigar cutter, reference can be made to the Spanish Utility Models numbers 231.715; 260.436; 287.023; U-9101517 and U-9200936, all of which include the basic characteristics mentioned but which present problems and disadvantages, one of these consisting in the cigar cutter being of the pocket type and, as such, designed to be of reduced size, flat and elementary, which results in a poor guidance mechanism for the cutting blade, as well as progressive misalignment between parts, the device thereby loosing its operational effectiveness and, on occasions, becoming unserviceable.

On the other hand, the aforementioned cigar cutters were not designed to be devices which serve simultaneously as cigar cutters per se as well as decorative objects, nor were they designed to be quality products, both with respect to their structural characteristics and with respect to the materials that essentially constitute the parts or elements of which the cigar cutter is formed.

DESCRIPTION OF THE INVENTION

The cigar cutter of the invention, in addition to being designed to be an element to effect the cutting or slicing of the extremities of cigars, a function which it performs effectively, includes structural characteristics such that the operation of the cigar cutter is improved, its useful lifetime is extended, and it even constitutes a decorative item of pleasing appearance, independently of the function for which it is intended.

In this sense, the cigar cutter of the invention is determined by a cutting blade, as in conventional practice, with an oblique cutting edge, this blade being mounted in a bridging piece that slides axially in a guided manner, as a consequence of it including a pair of pins which, in collaboration with their respective springs, slide internally in housings shaped internally between two flat, parallel plates duly fixed to each other in order to constitute the general body of the cigar cutter, this body being traversed by a transversal orifice for the positioning and respective slicing of the cigar extremity, an operation which is performed by the corresponding cutting blade, which can be moved axially, that is, upwards and downwards, in the first case through the effect of the springs associated with the pins of the bridging piece and, in the second case, by an external, manual pushing action, since the said blade is fixed to the sliding bridging piece.

The element called the bridging piece, which includes a part that projects beyond the body of the cigar cutter in order to effect the manual push referred to above, incorporates a locking pawl associated with a metal strip, the pawl being complementary to and interlocks with another which is fixed to one of the flat plates between which is mounted the assembly of the above mentioned mechanism, whereby, on pushing down on the bridging piece and therewith the cutting blade, the pawls interlock and fix the mechanism in this position, corresponding precisely to the situation of slicing through the cigar which has one extremity inserted in the hole or orifice in the casing, while, when a side-mounted push-button is depressed, the pawl associated with the metal strip is displaced inwards producing therewith its unlocking with respect to the other pawl, with which the thrust of the springs mounted on the pins of the bridging piece results in the latter being pushed outwards, its movement being limited logically by the fact that the bridging piece comes up against the inside of the body constituted by the plates in which the mechanism assembly is housed.

The cigar cutter so formed is completed with an external casing or cover of suitable shape and having a pleasing and decorative appearance, in which orifices are formed both for the insertion of the cigar to be cut and for the movement of the side-mounted push-button, being further complemented with a decorative element serving as a push button coupled to the upper, projecting part of the bridging piece.

Obviously the cigar cutter can be made of any appropriate material, though certain parts can be made from noble metals, as well as the casing itself, and thereby form an object which is not only a tool for cutting or slicing cigars, but also an article which is both decorative and of high quality.

BRIEF DESCRIPTION OF THE DRAWINGS

To complement the description which follows and in order to assist in a clearer understanding of the characteristics of the invention, attached to this technical description is a set of drawings based on which the innovations and advantages of the cigar cutter realised in accordance with the object of the invention are more easily seen.

DESCRIPTION OF THE PREFERRED EMBODIMENT

Figure 1:
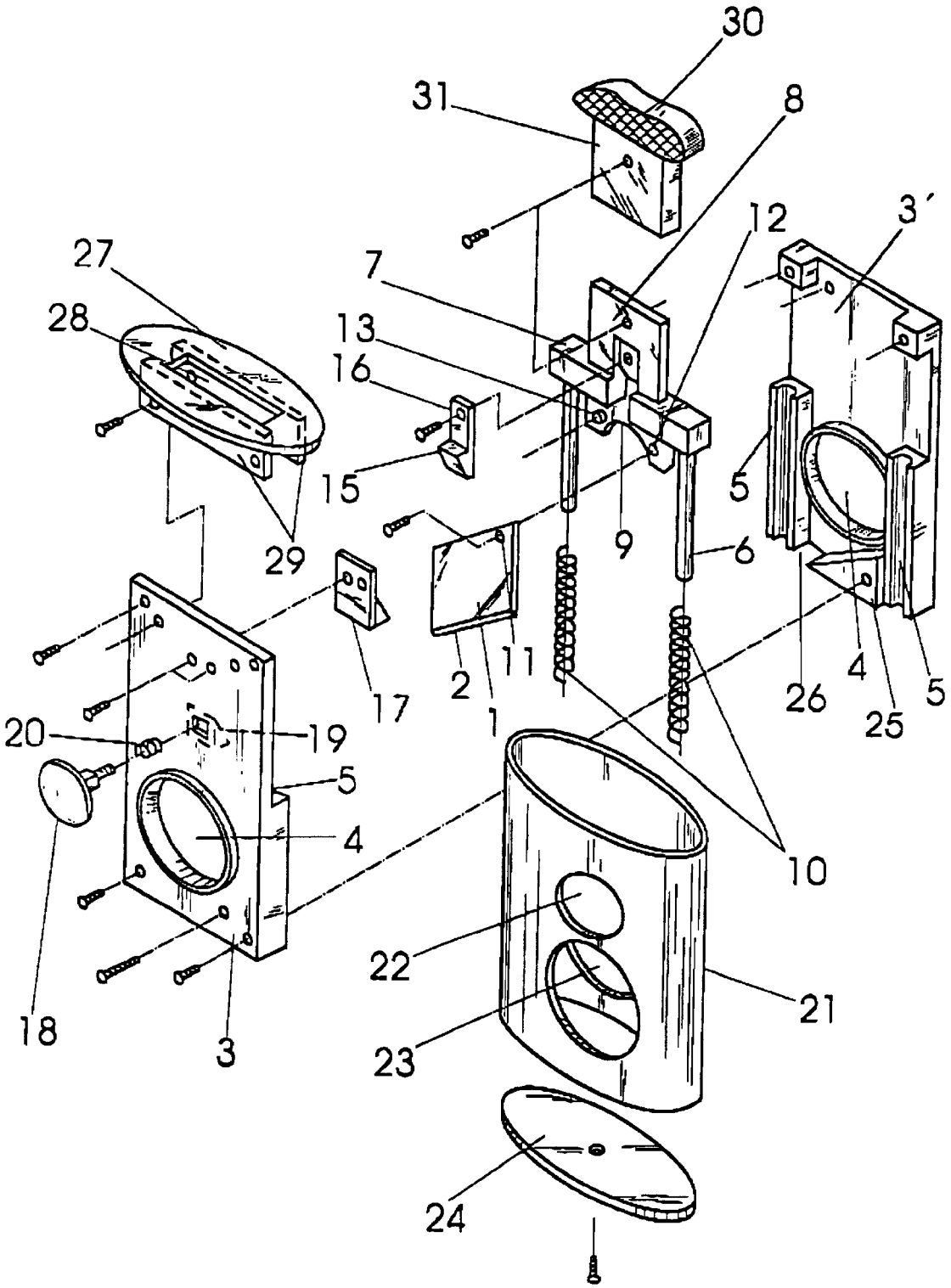
FIG. 1.—Showing a general, exploded view, in perspective, of the different pieces and parts that constitute the cigar cutter of the invention.
Figure 2:
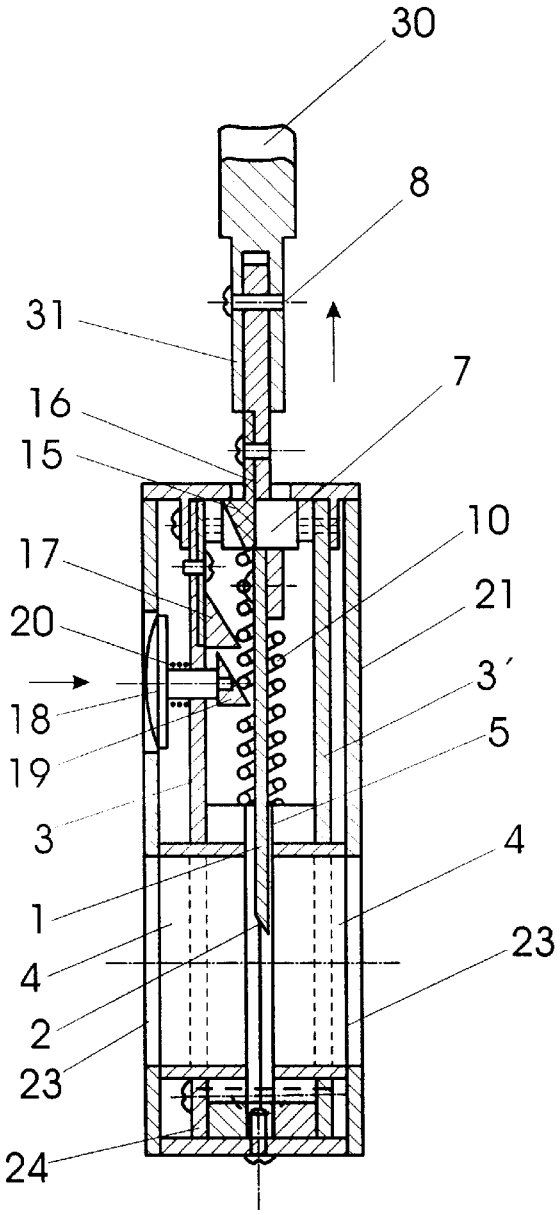
FIG. 2.—Showing a cross-section of the cigar cutter, with the cutting blade in the non-operational position.
Figure 3:
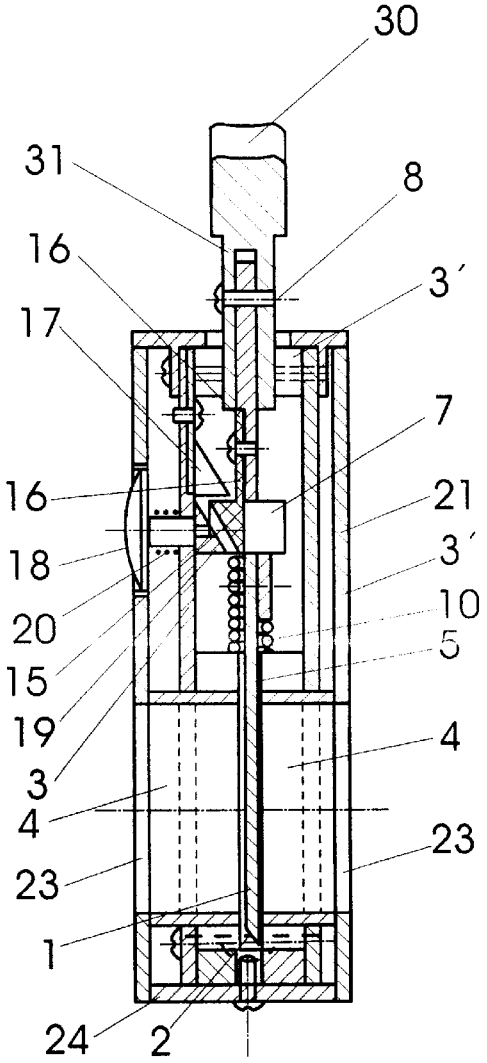
FIG. 3.—Showing a cross-section of the cigar cutter, analogous to the previous figure with the cutting blade in the operational position.
Figure 4:
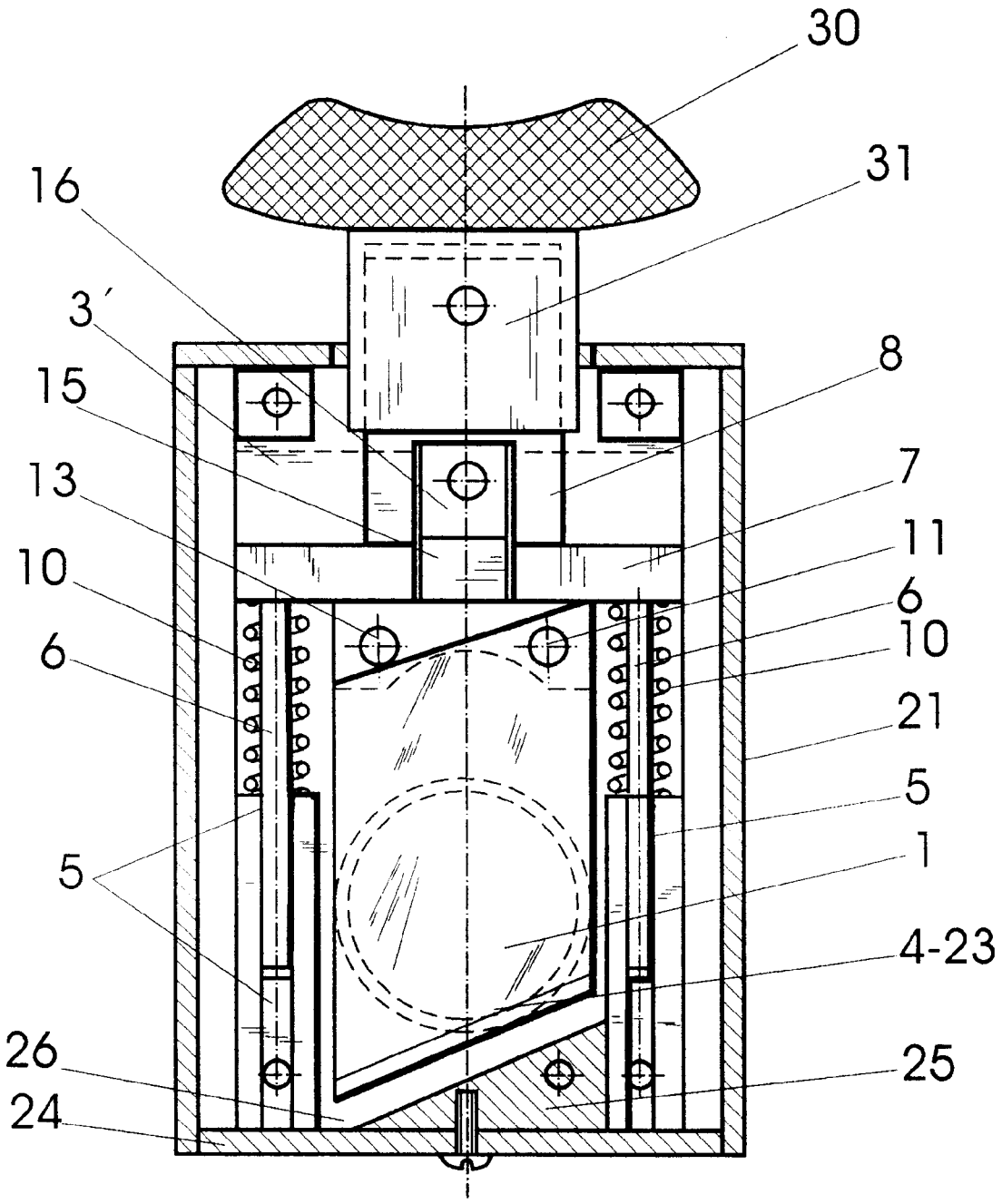
FIG. 4.—Showing a cross-section, but on a plane perpendicular to the cutting plane of FIGS. 2 and 3, permitting other details of the actual cigar cutter to be seen.

In the light of the figures mentioned, it can be seen how the cigar cutter of the invention includes, as in conventional practice, a cutting blade 1 with its corresponding oblique, cutting edge 2, this blade being movable axially inside a body formed by two plates 3 and 3' each of which having a large orifice 41 these holes being directly opposite each other in order to define a common space in which the extremity of the cigar to be cut shall be positioned. The inside faces of both plates 3 and 3', in correspondence with a segment of their longitudinal edges, have been provided with respective grooved projections 5, semi-cylindrical in shape, such that when the two plates 3 and 3' are fastened together, this fastening being possible by any conventional method, such as screws or other means, they define cylindrical housings in which are located, with facility to move in an axial direction, the respective pins 6 projecting from a bridging piece 7 with an upper part 8 projecting in an axial direction and a lower part 9 which is situated between the pins 6 and which constitutes the means for securing the cutting blade 1. The pins 6 are each accompanied by a spring 10 which is located between the opening of the upper end of the aforementioned cylindrical housings and the actual bridging piece 7, the said springs constantly pushing the bridging piece and, consequently, the cutting blade 1, outwards, in order to leave free the space defined by the orifices 4 of the plates that constitute the body of the cigar cutter, the entire mechanism which forms the said bridging piece with the blade and springs being held within the body defined by the plates 3 and 3', while the emerging part 8 projects above the body, through one of its extremities.

The cutting blade 1 is fixed to the part 9 of the bridging piece 7 by means of a screw passing through the hole 11 in the blade and which screws into the orifice 12 of the said part 9, this latter having a projection or knuckle 13 which acts as a stop for the upper edge of the blade 1, that is, the opposite edge to the cutting edge 2. Clearly the manner of support to prevent the blade from rocking or tilting could be one of many, such as projections on part 9 that match, for example, one of the corners of the blade 1 impeding its rocking to and forth. Likewise, the body could be fitted internally with a means for guidance of the actual blade 1, whereby, when the latter performs the cigar cutting action, it does not bend.

On the bridging piece 7 is fixed a pawl 15 which forms part of an elastic strip 16, this being the element that is fastened to the said bridging piece 7, specifically to its projecting part 8, this pawl 15 being located opposite another 17, in the reverse position to the first and fixed to the inside face of plate 3 corresponding to the body, whereby the two pawls interlock in the position of maximum inwards displacement of bridging piece 7 and consequently of the blade 1; it is further provided for that the said locking action can be released by laterally depressing push button 18 with internal butt 19 capable of acting on the pawl 15 pushing it inwards, this being possible due to the elasticity of the strip 16 on which the said pawl 15 is located, the effect of this thrust being to free the said pawl 15 from pawl 17 and consequently produce the reverse motion of the bridging piece 7 with cutting blade 1.

The push button 18 has associated with it a spring 20 which tends to push it outwards so that the internal butt 19 is left slightly separated from pawl 15.

The cigar cutter so formed is completed with a cover or casing in a noble metal 21, with orifice 22 to permit access to the push button 18 and with orifices 23 which align with orifices 4 to define the space in which the extremity of the cigar is positioned; the said casing 21 shall be closed at the lower end by means of a plate or base 24 possibly forming part of the former or being an independent piece, in which case it shall be fixed in place by means of a screw which passes through the said plate and screws into a hole provided for this purpose in an internal part 25 provided in the lower part or extremity of the body itself, this part 25 would constitute another, angled, projection in a suitable arrangement or configuration to also determine an exit passage 26 for the sliced off part of the cigar.

At the top end, the casing 21 is completed with another plate 27 with a rectangular window 28 to permit the emergence of the upper part 8 of the bridging piece 7, the said plate 27 having two small lugs 29 underneath on the inside for fixing it to the upper part of plates 3 and 3' of the body of the cigar cutter.

The assembly is finally completed with an anatomically shaped push button 30 having a hollow part 31 in which is positioned and hidden by insertion the projecting part 8 of the bridging piece 7, thus externally forming a cover assembly of pleasing appearance, with the possibility that all these parts, even some of the internal ones, be made from noble metals.

The operation of the cigar cutter described above is as follows:

In the locked position of pawls 15 and 17, the bridging piece 7 and consequently the cutting blade 1 are thrust inwards, this being considered to be the idle position, closing the passage defined by the orifices 4 of the body and 23 of the casing. If it is required to cut a cigar, the push button 18 has to be depressed inwards, the butt 19 of which will come up against pawl 15 separating it from pawl 17, releasing the locked condition, whence by means of springs 10 the bridging piece 7 and consequently the cutting blade 1 are pushed upwards, in such a fashion that the cutting edge 2 of the blade 1 is situated above the passage defined by the aforementioned orifices 4 and 23, it then being possible to position the extremity of the cigar in the said passage. The cutting of the cigar in question is done by pressing down on push button 30 which results in an inward thrust, pushing against the springs 10, of the bridging piece 7 and consequently the cutting blade 1, the cutting edge of which performs the slicing of the cigar situated in the passage mentioned.

The depression and inward thrust, at full total displacement of the bridging piece 7, results in the relocking of the pawls 15 and 17, the mechanism being retained in this position until being employed again.

I claim:

1. An improved cigar cutter comprising:

a body formed of two plates, said plates having facing orifices defining a passage for positioning an end of a cigar to be cut, and a slidable cutting blade having a cutting edge and disposed between the two plates;

a bridging piece for mounting the cutting blade and having a pair of pins which are guided in respective housings formed in the plates;

springs mounted on the pair of pins for biasing the bridging piece to an extended position away from the facing orifices; and a first pawl on the bridging piece cooperating with a second pawl on one of the plates for locking the bridging piece in a retracted locking position blocking the passage.

2. The improved cigar cutter as in claim 1, wherein the first pawl is integrally formed with an elastic strip (16), the cigar cutter further comprises a first push button for tilting the elastic strip to release the first pawl from the locking position with the second pawl so that the bridging piece returns to the extended position to permit insertion of the end of the cigar into the orifices.

3. The improved cigar cutter as in claim 2 further comprising a casing for housing the plates, said casing having orifices aligned with the orifices of the plates for receiving the end of the cigar, and an orifice formed in the casing for receiving the push button, the cigar cutter further comprising a protuberance formed on an inner side of the body, a lower closing plate fixed to the protuberance by a screw for closing a lower end of the casing, and said protuberance providing an exit passage with the lower closing plate.

4. The improved cigar cutter as in claim 3 wherein the bridging piece has a protruding part, and said cigar cutter further comprises an upper closing plate having a window for providing a passage to the protruding part, and a second push button having a hollow portion for receiving the protruding part, whereby applying a downward pressure to the second push button effecting the depression of the bridging piece and consequently moving the cutting blade to perform its cutting operation.

5. The improved cigar cutter as in claim 1 further comprising a casing for housing the plates, said casing having orifices aligned with the orifices of the plates for receiving the end of the cigar, and an orifice formed in the casing for receiving a first push button, the cigar cutter further comprising a protuberance formed on an inner side of the body, a lower closing plate fixed to the protuberance by a screw for closing a lower end of the casing, and said protuberance providing an exit passage with the lower closing plate.

6. The improved cigar cutter as in claim 5 wherein the bridging piece has a protruding part, and said cigar cutter further comprises an upper closing plate having a window for providing a passage to the protruding part, and a second push button having a hollow portion for receiving the protruding part, whereby applying a downward pressure to the second push button effecting the depression of the bridging piece and consequently moving the cutting blade to perform its cutting operation.

* * * * *